United States Patent [19]

Arff

[11] Patent Number: 4,604,772

[45] Date of Patent: Aug. 12, 1986

[54] DEVICE FOR TENSIONING BELTS OR THE LIKE

[75] Inventor: Heino Arff, Hamburg, Fed. Rep. of Germany

[73] Assignee: ITW-Ateco GmbH, Norderstedt, Fed. Rep. of Germany

[21] Appl. No.: 658,948

[22] Filed: Oct. 9, 1984

[30] Foreign Application Priority Data

Oct. 11, 1983 [DE] Fed. Rep. of Germany ... 8329307[U]

[51] Int. Cl.[4] ..... A44B 11/25

[52] U.S. Cl. ..... 24/68 R; 24/68 CD; 24/170; 24/180; 24/311

[58] Field of Search ..... 24/311, 170, 173, 174, 24/191, 192, 68 R, 68 CD, 68 E, 71 T, 71.2, 265 CD, 636, 643, 180, 176

[56] References Cited

U.S. PATENT DOCUMENTS

| | | | |
|---|---|---|---|
| 857,864 | 6/1907 | Bowyer | 24/180 |
| 988,078 | 3/1911 | Carter | 24/176 |
| 1,654,805 | 1/1928 | Hamric | 24/180 |
| 2,537,307 | 1/1951 | Griswold | 24/170 |
| 3,212,152 | 10/1965 | Tanaka et al. | 24/311 |
| 3,252,188 | 5/1966 | Davis | 24/68 E |
| 3,365,756 | 1/1968 | Bayon | 24/311 |
| 3,600,760 | 8/1971 | Eshleman | 24/68 R |
| 3,703,024 | 11/1972 | Johnson | 24/68 CD |
| 3,818,548 | 6/1974 | Meyerson | 24/191 |
| 4,158,904 | 6/1979 | Learn | 24/311 |
| 4,387,489 | 6/1983 | Dudek | 24/170 |
| 4,477,949 | 10/1984 | Calabro | 24/185 |

FOREIGN PATENT DOCUMENTS

| | | | |
|---|---|---|---|
| 70773 | 4/1952 | Netherlands | 24/191 |

*Primary Examiner*—Victor N. Sakran

*Attorney, Agent, or Firm*—J. P. O'Brien; A. J. Brunett; T. W. Buckman

[57] ABSTRACT

A device for tensioning belts or the like, comprising a first portion adapted to have one end of the belt fastened thereto and a second portion adapted to be brought into engagement with a portion of the belt spaced through a distance from one end of the belt and locating the same in the tensioning position vis-à-vis the first portion, whereby the two portions which are formed of synthetic material are adapted to be connected to each other and to the belt in a manner to be pivotable such that upon pivotal movement into the tensioning position a limited shortening occurs in the length clamped by the belt between the two points that have been established, and in that the portions are interlockable in the clamping position via an arresting connection, said arresting connection being releasable by means of an actuation portion accessible from outside.

2 Claims, 8 Drawing Figures

Fig. 4
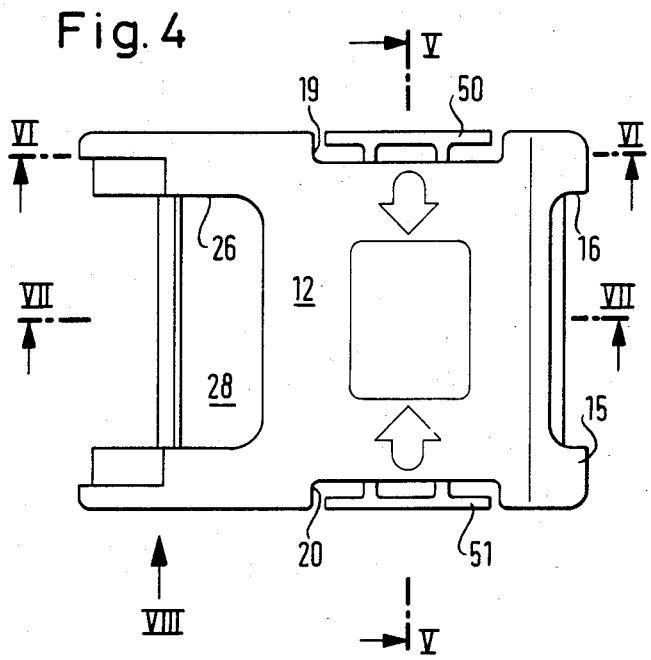
Fig. 5
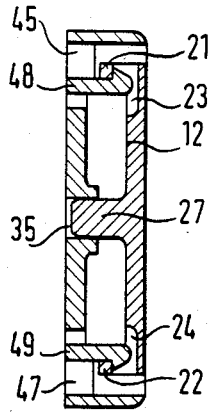
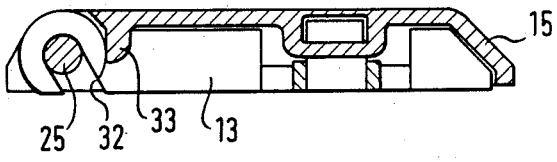
Fig. 6
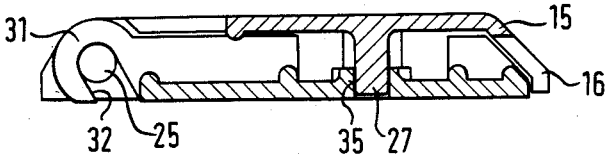
Fig. 7
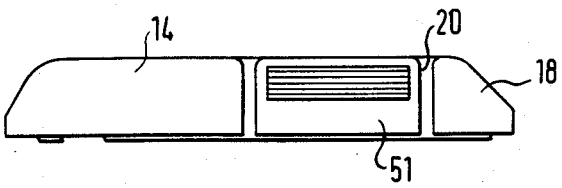
Fig. 8

DEVICE FOR TENSIONING BELTS OR THE LIKE

The invention relates to a device for making belts or the like tense, comprising a first portion adapted to have one end of the belt fastened thereto and a second portion adapted to be brought into engagement with a portion of the belt spaced through a distance from the end of the belt and locating the same in the tensioning position vis-à-vis the first portion.

The simplest shape a tensioning device for belts, webs or the like may take is the shape of a buckle. It suffers, however, from the disadvantage that both for locating and loosening the belt must be pulled tighter beyond the tensioning length, in order to respectively accomplish locating or loosening of the belt. This may under certain circumstances require the exertion of substantial power and does not always lead to an optimal tensioning of the belt.

It is the object of the invention to provide an effectively tensioning and easily operable device for tensioning belts or the like.

This object is attained in accordance with the innovation in that the two portions formed of synthetic material are capable of being pivotally connected to each other in such a manner that upon pivotal movement into the tensioning position a limited shortening is effected in the length clamped by the belt between the fixed points, and in that the portions may be interlocked in the clamping position via an arresting connection adapted to be released by means of an actuating portion accessible from outside.

The pivotal connection between the belt tensioning portions suitably is effected at one end of the portions, so that they may respectively be pivoted towards and away from each other like jaws. In the clamping position the portions are hinged together one upon the other. In the opened position the portions are more or less wide hinged open, so that the movable belt end may respectively be located at or detached from a portion without causing any problems. If, now, with the second releasable belt end the second portion is hinged upon the first one, a tensioning of the belt is effected over a limited length through the corresponding kinematics of the bearing means for the parts, said tension not being released again even in the clamping position. In the clamping position a snap-type interlocking engagement is effected between the portions preferably automatically, which may be released again by simple manual actuation.

According to another embodiment of the invention provision is made for one portion to comprise two pivot pins directed towards each other which are received in one side open slots of the other portion. The slots preferably are arranged in such a manner that the pins may slide out of them only if the belt tensioning portions are pivoted far beyond the normal opening position. For this purpose the pivot pins may have suitable stops associated thereto which normally prevent the pivot pins being moved out of the slots.

In another embodiment of the innovation provision is made for the first portion to comprise a bush-like aperture at the inner surface thereof and for the second portion to comprise a projection at its inner surface which is adapted to be plugged through the belt being passed over a recess of the second portion, and is accommodated by the aperture in the clamping position. The aperture is preferably kept free of the belt end which is tightly connected to the first portion, so that the projection may enter the aperture unobstructed.

With a suitable type of belt web the projection may be forced through the belt at any desirable location. Alternatively, the belt may be provided with a series of holes through which the projection may be selectively introduced.

According to another embodiment of the invention provision is made for the portions to form an approximately closed flat housing in the clamping position with openings for the belt at opposite sides. The housing may have an attractive shape and may be relatively flat, in order to avoid unnecessary increases in dimension when applied, for instance, to suitcases etc. In the clamping position the means securing the belts are invisible and inaccessible, so that even inadvertent release is not possible.

In the clamping position both portions are kept against each other by means of a snap-type interlocking arrangement. There are various constructional alternatives that may be imagined. A preferred embodiment of the invention provides for the snap-type interlocking means to comprise two latch-type projections which may be deflected to be out of the way and which are engaging behind an arresting surface at the other portion in the clamping position. The arresting latches are preferably disposed on opposite sides on both sides of the belt and are deflected or pivoted out of the way via the actuating portions, in order to effect an unlocking operation.

In accordance with a further embodiment of the invention the latch-type projections are formed integrally over free-standing webs, and the actuating portions arranged on the outer surface of the projections are effective to bring about a rotary and/or deflective deformation of the webs. The webs may have the effect of a torsion spring over which the arresting latches are formed integrally with the associated portion. If a pressure is exerted laterally on the associated actuating portion with a torque applied around the webs, the latter will become subjected to such torque and will be effective to cause pivotal movement of the arresting latches. As the webs are elastic also in a transverse direction, a deflexion is also taking place in a certain degree simultaneously.

So that they may not constitute any obstruction when sliding along or when moving along other components and so that also no inadvertant actuation of the arresting latches may take place, provision is made in another embodiment of the invention for the actuating portions to be arranged inside the contour of the housing.

In the following, an example of embodiment of the innovation will be explained in more detail by way of drawings.

FIG. 4 shows the top plan view taken on the device according to the invention.

FIG. 5 shows a sectional view of the representation according to FIG. 4 taken along line 5—5.

FIG. 6 shows a sectional view of the representation according to FIG. 4 taken along line 6—6.

FIG. 7 show a sectional view of the representation according to FIG. 4 taken along line 7—7.

FIG. 8 shows a lateral view of the device according to FIG. 4 taken in the direction of the arrow 8.

Figure 1:
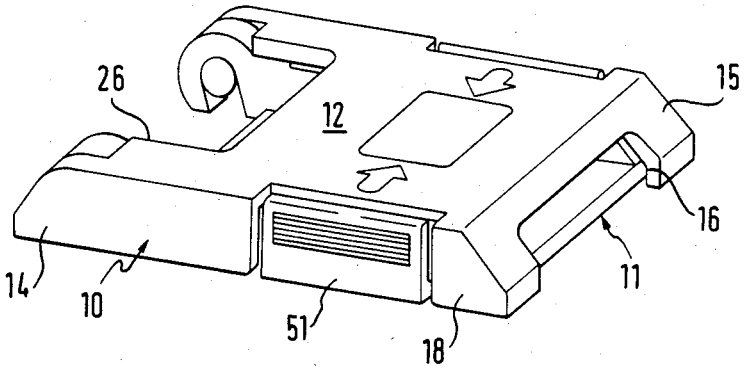
FIG. 1 shows a perspective view of a device according to the invention.
Figure 2:
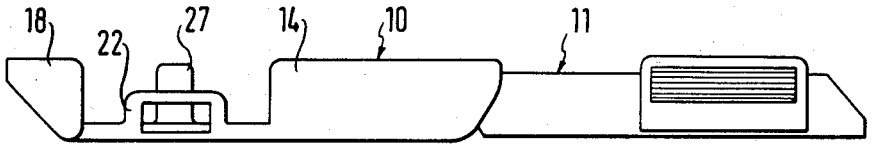
FIG. 2 shows a lateral view of the device according to FIG. 1 in the hinged open condition.

Prior to enlarging in more detail on the individual representations shown in the drawings it has to be stated that each of the parts described is of essential importance to the invention by itself or in connection with features of the claims.

The belt tensioning device shown in the drawings 1 to 8 comprises a first portion 10 and a second portion 11 which when folded together in the condition as shown in FIG. 1 or in the tensioning position form a flat housing having a rectangular contour.

Portion 10 has a cover plate 12 and lateral wall portions 13, 14 as well as an end face 15 with an elongated recess 16 of a width slightly greater than that of the belt (not shown) to be connected to the belt tensioning device. Connected to the end wall portion 15 are side wall portions 17 and 18, respectively, directly adjacent thereto. Recesses 19 and 20 are respectively arranged between the respective side wall portions 13, 17 and 14, 18. Brackets 21 and 22, respectively, are formed integrally with the cover plate 12 to border the recess 19, 20. At the inner surface of the brackets 21, 22 a rectangular deepening 23 and 24, respectively, is formed in the cover plate 12.

Coaxial bearing pins pointing towards each other are formed integrally at the lateral wall portions 13, 14, one of them being shown at 25 in FIGS. 6 and 7.

Formed in the cover plate 12 is a large rectangular recess 26 which is open to the rear. The width thereof corresponds to the width of the recess 16 in the end wall 15, which is skewed in the upper region of the cover plate 12 approximately as seen in FIG. 1. Formed centrally at the cover plate on the inner surface thereof is a pin 27.

Figure 3:
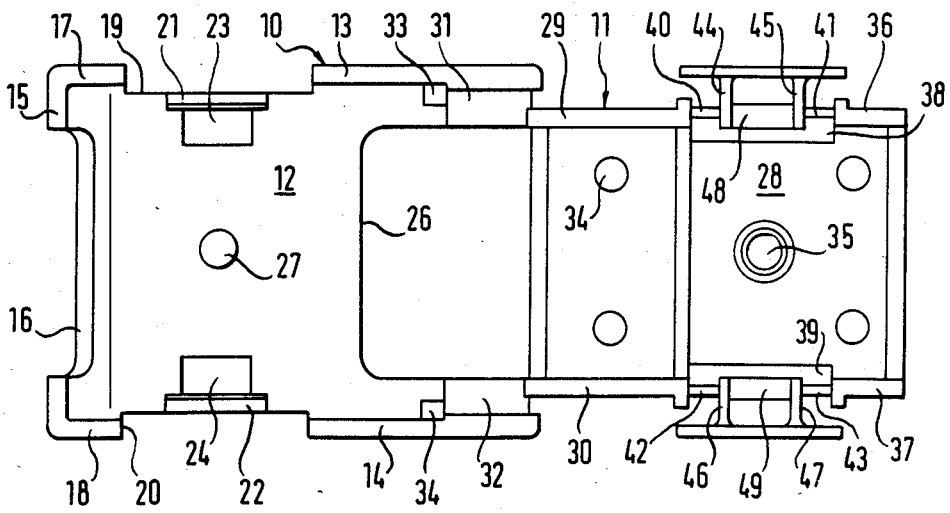
FIG. 3 shows a top plan view taken on the representation according to FIG. 2.

The second portion has a cover plate 28 as well as side wall portions 29, 30 formed integrally therewith. Hooks 31, 32 are formed in extension of the side wall portions with a one-side opening elongated hole 32 (see FIG. 7) for the accommodation of the bearing pins 25. Near the bearing pins abutments 33, 34 are formed integrally with the side wall 13, 14. The slots 32 accommodate the bearing pins 25 in order to pivotally connect the two portions 10, 11 with each other. They accommodate the radial bearing pressure and prevent distortion to the pins 25. The abutments 33, 34 ensure that even in case of being hinged open according to FIG. 3 with the portions 10, 11 hinged away from each other by 180° from the positiion according to FIG. 1, detachment of the two portions is not possible. Only when the portions are pivoted further about an angle of up to approximately 270° the bearing pins can slide out of the slots 32. The slots 32 may additionally be provided with small arresting projections preventing sliding out movement even when the components are pivoted by more than 270°.

Formed in the bearing plate 28 near the corners are four holes 34 for the purpose of locating a belt end by riveting, for example. A bush-shaped hole 35 is disposed approximately centrally in the bearing plate 28 having the pin 27 engaging therein when the belt tensioning means is in the closed position or in the tensioning position. Owing to the engagement of the mandrel 27 in the hole 35, the pins 25 are relieved of the bending stress.

The second portion has forward side wall portions 36, 37. In the space between the side wall portions 29, 30 and 36, 37, respectively, the cover plate 28 is provided with recesses 38, 39. The recesses 38, 39 are partly bridged by web portions 40, 41 and 42, 43, respectively, which are formed integrally at the associated wall portions 29, 36 and 30, 37, respectively. The other ends of the web portions 40 to 43 are connected to transverse webs 44 to 47 which for their part are connected to an arresting latch 48 and 49, respectively. Connected to the webs 44 to 47 are furthermore actuating portions 50, 51 in the form of small plates which in the closed condition according to FIG. 1 to 4, are aligned with the side wall portions 13, 14 of the first portion 10 and are disposed within the recess 19, 20. Thus, they are disposed inside the contour of the housing of the belt tensioner and, therefore, cannot be readily actuated inadvertently.

Use and mode of operation of the belt tensioner shown are as follows.

One end of a belt, for example, a belt for a suitcase adjustable in width is riveted to the cover plate 28 of the second portion 11. The hole 35 preferably is left free in this operation. The first portion 10 is hinged open at an angle to the second portion 11, for instance, by 90° for tensioning purposes. The other belt end is passed through the recess 26, and the belt is located gainst the inner surface of the cover plate 12 via the pin 27 either by plugging it through a prepared hole in the belt or through the belt web. If, now, the first portion 10 is pivoted vis-à-vis the second portion 11 in the direction towards the tensioned position, the belt is also pivoted and is thereby simultaneously tensioned in a not insubstantial degree. Near the closing position according to FIG. 1 the pin 27 engages within the hole 35. When the tensioning or the closing position is reached, the arresting projections of the interlocking latches 48, 49 come to hook over the brackets 21, 22 with the free ends of the arresting latches 48, 49 in part engaging within the deepenings 23, 24 of the cover plate 12. The brackets 12, 22 and the arresting latches 48, 49 or the free end thereof, respectively, are arranged and configured in such a manner that the interlocking engagement as described may take place, and is maintained, automatically. For this purpose the free ends of the arresting latches 48, 49 are provided with skewed surfaces, not provided with a reference number.

If the interlocking engagement is to be released, a pressure is exerted laterally on the key-like actuation portions 50, 51. As the latter are tied to the webs 44 to 47 at the lower end the actuation pressure will bring about a pivotal movement of the keys 50, 51 about the axis of the longitudinal webs 40 to 43 which thereby are effective in the manner of torsion springs. Such a pivotal movement leads towards pivoting the arresting latches 48, 49 together which thereby release the brackets 21, 22. By a corresponding bias it may be seen to it that the two portions 10, 11 move away from each other through a short distance so that a pressure need be exerted only on the actuating keys 50, 51, in order to detach the two portions from each other without having to perform simultaneously a pivotal movement by hand. Finally, the two portions are pivoted away from each other so that the detachable belt portion may be removed from the first portion.

Upon pivotal movement of the belt tensioner portions 10, 11 into the position of tensioning the dead center position is approximately obtained but not surpassed, so that a repeated yielding of the belt in the end position does not take place. The energy absorption in the belt tensioner, however, is such that an essentially axial load occurs which is effective on the one hand between the pin 27 and the hole 35 and on the other hand between the bearing pin 25 and the slot 32.

I claim:

1. A two-piece plastic belt tensioning device having and open and latched position comprising:

a base member having top and bottom sides, a beveled aperture and a rivet means for permanently affixing a first end of a belt thereto;

a cover member having top and bottom sides with a peg means integrally formed to said bottom of said cover for engaging an aperture formed in said belt, for affixing sald belt to said cover at a point intermediate the ends of said belt and for engagement with said beveled aperture;

prong and hook means integrally formed on opposite sides of said bottom of said cover and said top of said base respectively for hingedly connecting said base to said cover at one of their respective ends; and means for latching said base to said cover upon rotation about said hinge means at their respective ends opposite said hinge means said means for latching said base to said cover having a pair of resilient catch members integrally formed on opposite sides of said top of said base and a pair of loop members integrally formed on opposite sides of said bottom of said cover which engage said catch members when said cover is rotated to said final latched position, each of said catch members having an integrally formed tab means which is engageable from the outside of said device for disengaging said catch from said loop when said tab means is properly displaced toward the interior of said device whereby upon latching, said point intermediate the ends of said belt is further tensioned with respect to said first end of said belt.

2. A two-piece plastic belt tensioning device comprising:

a flat rectangular base member having a top and bottom surface, a beveled central aperture and a width slightly larger than a belt to which it is to be fastened, said base having a pair of upstanding resilient catch members integrally formed on opposite sides of one end of its top surface, each of said catch members having an integrally formed tab means for providing a deflection of each of said catch members, and having a pair of hook members integrally formed on opposite sides of the top surface of said base at its end opposite said catch members; and a flat rectangular cover member having a top and bottom surface with an outwardly projecting integrally formed peg member on its bottom surface, said cover also having a pair of integrally formed outwardly projecting loop members on opposite sides of one end of the bottom of said cover member, and having a pair of prong means integrally formed on opposite sides of the bottom of said cover at its end opposite said loop members for hingedly engaging said respective hook members whereby upon rotation of said cover and said base to a final latched position about said hook and prong means increased tensioning is provided in said belt and each of said catch members engages its respective said loop member.

* * * * *